US007087275B2

(12) United States Patent
Baker et al.

(10) Patent No.: US 7,087,275 B2
(45) Date of Patent: Aug. 8, 2006

(54) INK JET RECORDING MEDIA AND METHOD FOR THEIR PREPARATION

(75) Inventors: Julie Baker, Abbots Langley (GB); Malcolm D. Purbrick, Bushey (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/158,665

(22) Filed: May 30, 2002

(65) Prior Publication Data

US 2003/0021963 A1 Jan. 30, 2003

(30) Foreign Application Priority Data

Jul. 10, 2001 (GB) ..... 0116802

(51) Int. Cl.
*B41M 5/40* (2006.01)

(52) U.S. Cl. ..... 428/32.27; 428/32.3; 428/32.34; 428/32.38

(58) Field of Classification Search ..... 428/32.27, 428/32.3, 32.34, 32.38
See application file for complete search history.

(56) References Cited

U.S. PATENT DOCUMENTS

| | | | | |
|---|---|---|---|---|
| 4,517,244 A | | 5/1985 | Kobayashi et al. | 428/342 |
| 5,212,008 A | | 5/1993 | Malhortra et al. | 428/216 |
| 5,888,629 A | | 3/1999 | Lubar | 428/212 |
| 5,985,425 A | * | 11/1999 | Tomizawa et al. | 428/212 |
| 6,089,704 A | * | 7/2000 | Burns et al. | 347/105 |
| 6,147,139 A | * | 11/2000 | Shaw-Klein et al. | 523/160 |
| 6,562,441 B1 | * | 5/2003 | Maeda et al. | 428/195 |
| 2002/0028320 A1 | * | 3/2002 | Iwasa et al. | 428/195 |

FOREIGN PATENT DOCUMENTS

| | | | |
|---|---|---|---|
| EP | 0 919 395 A | | 6/1999 |
| EP | 1 020 300 A | | 7/2000 |
| EP | 0 916 512 B1 | | 7/2001 |
| EP | 1 275 516 A1 | * | 1/2003 |

* cited by examiner

*Primary Examiner*—B. Shewareged
(74) *Attorney, Agent, or Firm*—Harold E. Cole; Chris P. Konkol

(57) ABSTRACT

A coating fluid for application to a support to prepare an ink jet recording medium comprises an aqueous dispersion of a synthetic polymer hydrogel and gelatin, the amount of the synthetic polymer hydrogel being from 5 to 50% by weight of the combined weight of synthetic polymer and gelatin. Preferably the coating fluid also contains a mordant, an aliphatic alcohol to assist dispersion of the hydrogel polymer and a particulate material to impart a porous structure to the coating. The invention also provides an inkjet recording medium comprising a support on which is an ink-receiving layer comprising the gelatin and a synthetic polymer hydrogel. The amount of the latter may be from 0.3 to 5 g/square meter.

12 Claims, 1 Drawing Sheet

INK JET RECORDING MEDIA AND METHOD FOR THEIR PREPARATION

FIELD OF THE INVENTION

This invention relates to a coating fluid for application to a support to prepare ink jet recording medium, to a novel recording medium for use in an ink jet imaging process and to a method for the preparation of the novel ink jet recording medium.

BACKGROUND OF THE INVENTION

Ink jet printing is a process in which a stream of ink, preferably in the form of droplets, is ejected at high speed from nozzles against a medium so as to create an image.

Media used for inkjet recording need to be dimensionally stable, absorptive of ink, capable of providing a fixed image and compatible with the imaging materials and hardware. In many instances ink jet printing is carried out on simple paper media particularly in those instances where correspondence and the like is being reproduced.

The typical inks employed in ink jet processes have a fairly high solvent content and the solvents generally include high boiling slow drying polar materials such as glycols, glycol ethers and water. The presence of fairly large amounts of relatively high boiling solvents in the ink can result in the production of an image having a tacky and/or greasy feeling surface.

The recording sheet for an inkjet printer is required to swiftly absorb the ink and have good colour forming properties. To reduce the dry time of the ink it has been previously proposed to provide a recording sheet having a porous layer formed on a substrate, the porous layer being formed of an inorganic oxides such as aluminium oxides or silica.

U.S. Pat. No. 4,517,244 discloses an ink jet recording material having enhanced fixation rates comprising a support having therein a water insoluble resin having a water absorbing capacity of from 50 to 100 times its own weight.

U.S. Pat. No. 5,212,008 discloses a recording sheet which comprises a substrate having two coatings. The first coating comprises (a) a crosslinking agent and (b) a polymer such as a polysaccharide cross linkable by (a). The second coating which is in contact with the first comprises a binder and compound such as an alkoxylated di-fatty quaternary compound.

European Patent Application No 916512 describes a coating fluid for application to a substrate for use in ink jet printing, the coating fluid comprising alumina hydrate particles dispersed in an aqueous medium which contains as binders a polyvinyl alcohol and a polymerisable compound having a hydrocarbon group with a hydroxyl group or a compound having a polyoxyalkylene chain, said compound having a substituent with an unsaturated bond or an epoxy group. The polymerisable compounds disclosed are monomers. The fluid is applied to a substrate such as polyethylene terephthalate, dried and heated with a polymerization initiator to effect polymerization of the polymerizable compound. Compared with the use of polyvinyl alcohol without the polymerizable binder, the advantage stated is that peeling of the coated layer is avoided and good image quality is maintained for a long period of time.

U.S. Pat. No. 5,888,629 describes a medium for ink jet printing which includes a bottom layer of material having a very high absorption for the polar solvent component of the ink jet imaging ink together with a top layer of image receptor material comprising gelatin disposed in fluid communication therewith. The bottom layer which consists essentially of a hydrogel formed from a water insoluble hydrophilic polymer and a water soluble polymer has a very high affinity for the solvent component of the ink and tends to draw the solvent from the body of ink thereby preventing image spread and producing a localized highly saturated image.

PROBLEM TO BE SOLVED BY THE INVENTION

There is a continuing need to reduce the time taken for the image produced on the recording medium to dry.

In our copending PCT application No GB99/04223 there is described an ink jet recording medium comprising a support, an ink receiving layer and a top layer which top layer comprises a polymer that contains both a hydrophilic component and a hydrophobic component or a mixture of two or more such polymers, the polymer or polymer mixture being present in the top layer in an amount of from 0.003 to 0.5 g/square meter.

Our copending PCT application No GB 99/4243 describes an ink jet recording medium comprising a support, an ink receiving layer and a top layer which comprises a polymer containing both hydrophilic and hydrophobic components or a mixture of two or more such polymers, the polymer or polymer mixture being present in an amount of from 0.003 to 0.5 g/square meter and where the top layer has been hardened with an oxazoline functional polymer.

These specifications disclose that the polymeric overcoats give an improvement in dry times.

U.S. Pat. No. 5,190,805 discloses an ink jet recording medium in which a hydrogel is present in the ink-receiving layer. The hydrogels are said to provide good drying properties but insufficient to provide adequately rapid drying for intended applications. To solve this problem a pigment is used in a concentration that provides a high void volume. There is no disclosure of gelatin in the ink-receiving layer.

An ink jet recording medium has now been invented in which the dry time is significantly reduced by incorporating a synthetic polymer hydrogel into the gelatin-containing ink-receiving layer of the medium.

SUMMARY OF THE INVENTION

According to the present invention there is provided a coating fluid for application to a support to prepare an ink jet recording medium, said coating fluid comprising:

an aqueous dispersion of a synthetic polymer hydrogel and a gelatin, the amount of the synthetic polymer hydrogel being from 5 to 50% by weight of the combined weight of synthetic polymer and gelatin.

ADVENTAGEOUS EFFECT OF THE INVENTION

The incorporation of the polymer hydrogel into the gelatin-containing ink-receiving layer enables to drying time to be significantly reduced.

DETAILED DESCRIPTION OF THE INVENTION

Figure 1:
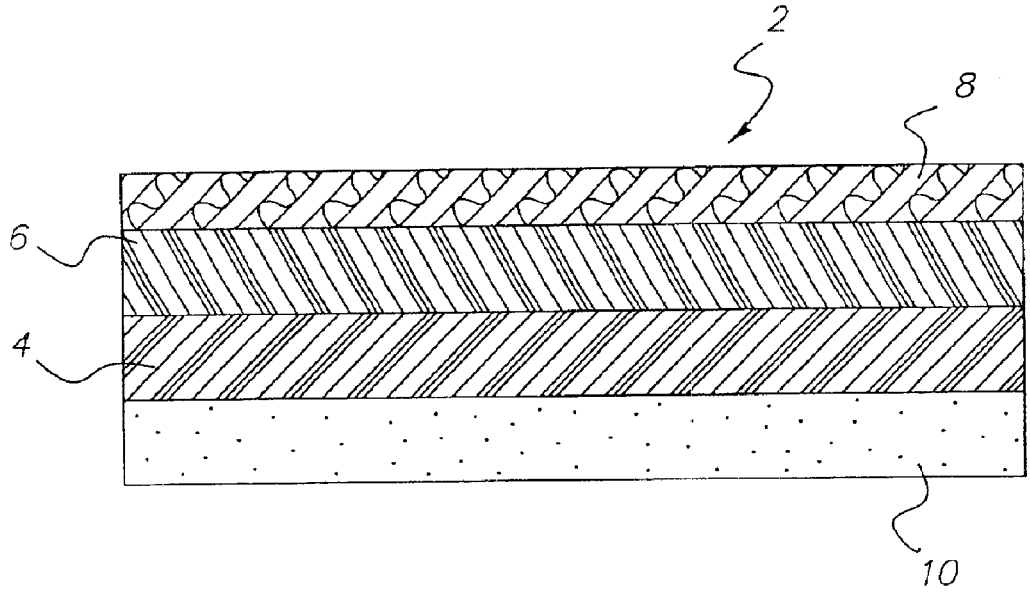
FIG. 1 is a cross-sectional view of one embodiment of an ink jet recording medium according to the invention.

The term ink in the present specification is meant to refer to all fluid based imaging materials which comprise a solvent and a coloring materials and coloring materials include pigments, dyes and lakes.

The term ink-receiving layer is the layer in which the image is formed and is sometimes referred to in the art as the image-forming layer.

By hydrogel is meant a synthetic polymer which is insoluble in water but capable of absorbing large quantities of water. Usually the polymer has a small degree of cross linking.

Unless the context requires otherwise references to the amount of hydrogel polymer are intended to refer to the polymer before it has absorbed water.

The term gelatin is intended to include not only gelatin itself but also derivatives such as acetylated gelatin, phthalated gelatin and oxidised gelatin and analogues which are capable of absorbing water and based on naturally occurring polymers such as chitosan.

Suitable polymer hydrogels for use in the present invention are those which, when in part replacing the gelatin in a coated layer, will enhance the water absorbing performance of that coated layer.

Preferred polymers are substituted and unsubstituted poly (hydroxyalkyl (meth)acrylates) and substituted and unsubstituted poly(hydroxyalkyl (meth) acrylamides) and poly (meth)acrylates and poly(meth)acrylamides bearing poly (alkene oxide) substituents.

Suitable amounts of synthetic polymer hydrogel are from 5 to 50% preferably from 20 to 35% by weight of the combined weight of gelatin and synthetic polymer hydrogel.

Preferably the coating fluid contains a mordant and preferably also an aliphatic alcohol to assist the dispersion of the synthetic polymer hydrogel.

Preferably the coating fluid also contains a particulate material for example a ceramic or hard polymeric material in particulate form to impart a porous structure to the coating.

According to another aspect of the invention an ink jet recording medium comprises:

(a) a support and (b) an ink-receiving layer supported on said support, said ink-receiving layer comprising a gelatin and a synthetic polymer hydrogel the polymer hydrogel being present in an amount of from about 5 to about 50% by weight of the combined weight of polymer hydrogel and gelatin.

The polymer hydrogel is conveniently present in an amount of from 0.3 to 5 g/square meter.

The ink-receiving layer preferably also includes a mordant, conveniently present in an amount of from 200 to 2000 mg/square meter, preferably from 500 to 1200 mg/square meter to improve waterfastness.

The mordant may typically be present in an amount of from about 2 to about 10% by weight of the ink-receiving layer. Useful mordants are disclosed in U.S. Pat. No. 5,474,843 the disclosure of which is incorporated herein by reference.

Preferably the ink-receiving layer also includes a particulate material to impart porosity, conveniently in an amount from 10 to 100 mg/square meter, preferably from 20 to 70 mg/square meter.

The medium may include an overcoat for example of a cellulose-containing material applied to the ink-receiving layer.

The recording medium can be opaque, transluscent or transparent.

Thus the supports utilised in the recording elements of the present invention are not particularly limited and may be chosen from a wide variety of materials.

For example the following may be used: plain papers, resin coated papers, various plastics for example a polyester-type resin such as poly(ethylenterephthalate), a fluorine-type resin such as ETFE, metal foil, various glass materials and the like can be employed as supports. When the support is trtansparent a transparent recording element can be obtained and used as a transparency in an overhead projector.

The supports are preferably self supporting by which is meant a support material such as a sheet of film that is capable of independent existence in the absence\e of a supporting support.

In certain preferred embodiments the support will be a sheet or sheet-like structure. The thickness of the support will usually be from 12 to 500 micrometers typically from 75 to 300 micrometers.

When the support is a thin sheet it may be advantageous to apply a coating for example a gel layer to the side of the support remote from the ink receiving layer and overcoat layer, with the object of reducing or eliminating any tendency to curl.

The ink-receiving layer usually has a thickness of 3 to 20 micrometers.

A porous structure may be introduced into the ink-receiving layer by the addition of ceramic or hard polymeric particulates, by foaming or blowing during coating, or by inducing phase separation in the layer through the introduction of nonsolvent. In general it is sufficient for the ink-receiving layer to be hydrophilic but not porous. This is especially true for photographic quality prints in which porosity may cause a loss in gloss.

Optionally rigidity may be imparted to the base layer through incorporation of a second phase comprising one or more materials such as polyesters, poly(methacrylates) and polyvinyl benzene-containing copolymers.

The ink-receiving layer may be pH adjusted to optimise swelling (water capacity) to enhance gloss or minimise dye migration. For example the pH of the layer may be reduced to 3.5 to improve swelling capacity, thereby reducing drying times, and impart waterfastness.

Alternatively the pH may be raised to 8.5 in order the enhance gloss and reduce bronzing due to surface dye crystallization.

In a preferred embodiment from 50 to 80% of the ink receiving layer comprises photographic grade gelatin modified such that the pH is far from the isoelectric point of such a gelatin, in order that water uptake may be maximized. The remainder of the layer may comprise polymer hydrogel and other components.

According to a further aspect of the present invention a method for the preparation of an ink jet recording medium comprises:

applying to a support a coating fluid comprising an aqueous dispersion containing a gelatin and a synthetic polymer hydrogel containing from 5 to 50% preferably from 20 to 35% by weight of synthetic polymer hydrogel based on the combined weight of gelatin and synthetic polymer hydrogel and allowing the fluid to dry to form an ink-receiving layer on the support.

Conveniently the amount of polymer hydrogel applied to the support is from 0.3 to 5.0 g/square meter, preferably from 0.8 to 2.0 g/square meter.

A mordant is preferably present in the coating fluid and is coated at an amount from 200 to 2000 mg/square meter, preferably from 500 to 1200 mg/square meter.

Preferably a particulate material is included in the fluid to impart porosity to the coating and is present in an amount to provide from 10 to 100 mg/square meter preferably from 20 to 70 mg/square meter.

An overcoat e.g. of a cellulose-containing material may be applied to the ink-receiving layer.

The layers described above including the ink-receiving layer and overcoat may be coated by conventional coating means onto the support e.g. a transparent or opaque support material commonly used in this art. Coating methods may include wound wire coating, slot coating, slide hopper coating, gravure, curtain coating and the like. Some of these methods allow for simultaneous coatings of both layers, which is preferred from a manufacturing economic perspective.

The inks used to image the recording elements according to the present invention are well known inks. The ink compositions used in ink-jet printing typically are liquid compositions comprising a solvent or carrier liquid, dyes or pigments, humectants, organic solvents, detergents, thickeners, preservatives and the like. The solvent or carrier liquid can be comprised solely of water or can be predominantly water mixed with one or more other water-miscible, solvents such as polyhydric alcohols, although inks in which organic materials such as polyhydric alcohols are the predominant carrier or solvent liquid also may be used. Particularly useful are mixed solvents of water and polyhydric alcohols. The dyes used in such compositions are typically water-soluble direct or acid type dyes. Such liquid compositions have been described extensively in the prior art including for example U.S. Pat. Nos. 4,381,946; 4,239,543 and 4,781,758.

The invention is illustrated by the following Example.

EXAMPLES

A dispersion of poly(hydroxypropylmethacrylate) was prepared as follows:

A solution of poly(hydroxypropylmethacrylate) (PHPMA) was made by dissolving the PHPMA very slowly in n-propanol at 40 degrees Centigrade. This solution was then added dropwise to an aqueous solution of gelatin, which was being stirred at 500 rpm and maintained at 50 degrees Centigrade. When this addition process was complete, the dispersion was stirred over night and a significant proportion of the n-propanol evaporated. The hydrogel thus prepared (dispersion A) was difficult to handle and any sudden changes in the hydrophilic balance of the medium in which they were suspended resulted in uncontrolled precipitation.

A mixture (mixture B) was prepared containing the following components in the following amounts: 848 mg/square meter of a cationic latex polymer (polymer of (m and p chloromethyl) ethenylbenzene and 2-methyl-2-propenoic acid 1,2-ethanediylester, quaternized with N,N-dimethylmethanamine) which acts as a mordant and 57 mg/square meter of polymeric matte (limited coalescence polystyrene beads, 12 microns).

An amount of dispersion A (8.84% gel, 3.7% PHPMA) to provide 1.47 g/square meter of PHPMA was then added to this mixture (mixture B). The resulting mixture (in the form of a gel) was applied to a resin coated paper support in an amount to provide 6.16 g/square meter of gelatin, 848 g/square meter of the mordant and 57 mg/square meter of the polymeric matte and allowed to dry to form an ink receiving layer An overcoat was then applied which consisted of a water soluble cationic cellulose ether (alkyl modified hydroxyethyl cellulose quaternary) coated at 861.12 mg/square meter, methyl cellulose (average molecular weight about 86,000) coated at 212.28 mg/meter.

The effect of incorporating the hydrogel PHPMA was determined by measuring the density of ink transferred to a piece of plain paper sandwiched to a printed image immediately after printing. The faster the sample dried the lower the ink density on the plain paper.

The results in Table 1 show the dry time ink density for a sample where the PHPMA has been incorporated into the ink-absorbing layer (invention) compared to a typical commercial product, in this case, Kodak (Registered Trade Mark) Ink Jet Photographic Quality Paper (comparison).

TABLE 1

| coating | Epson Stylus Photo 700 Dry time Ink Density |
|---|---|
| comparison | 1.041 |
| invention | 0.092 |

Printer set-up:

Epson Stylus Photo 700 printer with the following settings:

Photo Quality Ink Jet Paper 1440 dpi, Photo quality

The results in Table 1 indicate that when the hydrogel is incorporated into the ink receiving layer of the ink jet media, instant drying is achieved, as shown by an extremely low density of ink transferred to the piece of plain paper immediately after the image has been printed.

The invention is further illustrated by the accompanying drawing.

Referring to FIG. 1: a ink jet recording medium indicated generally by numeral 2 comprises a support in the form of a sheet 4 of resin coated paper on which is supported an ink-receiving layer 6 of gelatin and polymer hydrogel of composition as described in the above Example. Applied to layer 6 is an overcoat 8 of cellulose ether whose composition is also described in the above Example. On the underside of paper 4 is a gel layer 10 to reduce curl.

We claim:

1. An ink jet recording medium comprising:

(a) a support and (b) an ink-receiving layer supported on said support, said ink-receiving layer comprising a gelatin and a synthetic polymer hydrogel, which synthetic polymer is insoluble in water but capable of absorbing large quantities of water, the polymer hydrogel being present in an amount of from about 5 to about 50% by weight of the combined weight of polymer hydrogel and gelatin.

2. An ink jet recording medium as claimed in claim 1 wherein the polymer hydrogel is present in an amount of from 20 to 35% by weight of the combined weight of polymer hydrogel and gelatin.

3. An ink jet recording medium as claimed in claim 1 wherein the amount of polymer hydrogel is from 0.3 to 5 g/square meter.

4. An ink jet recording medium as claimed in claim 1 wherein the amount of polymer hydrogel is from 0.8 to 2.0 g/square meter.

5. An ink jet recording medium as claimed in claim 1 wherein the ink-receiving layer includes a mordant in an amount from 200 to 2000 mg/square meter.

6. An ink jet recording medium as claimed in claim 1 wherein the ink-receiving layer includes a mordant in an amount from 500 to 1200 mg/square meter.

7. An ink jet recording medium as claimed in claim 1 wherein the ink receiving layer includes a particulate material to impart porosity the amount of the particulate material being from 10 to 100 mg/square meter.

8. An ink jet recording medium as claimed in claim 1 wherein the ink receiving layer includes a particulate material to impart porosity the amount of the particulate material being from 20 to 70 mg/square meter.

9. An ink jet recording medium as claimed in claim 1 wherein the medium includes an overcoat applied to the ink-receiving layer.

10. An ink jet recording medium as claimed in claim 9 wherein the overcoat is a cellulose-containing overcoat.

11. An ink jet recording medium as claimed in claim 1 wherein the synthetic polymer hydrogel is selected from the group consisting of substituted and unsubstituted poly (hydroxyalkyl(meth)acrylates) and substituted and unsubstituted poly(hydroxyalkyl(meth)acrylamides and poly(meth) acrylates and poly(meth)acrylamides bearing poly(alkylene oxide) substituents.

12. An ink jet recording medium comprising:

(a) a support and (b) an ink-receiving layer supported on said support, said ink-receiving layer comprising a gelatin and a synthetic polymer hydrogel, which synthetic polymer is insoluble in water but capable of absorbing large quantities of water, the polymer hydrogel being present in an amount of from about 5 to about 50% by weight of the combined weight of polymer hydrogel and gelatin, wherein the synthetic polymer hydrogel is poly (hydroxypropylmethacrylate).

* * * * *